US005557829A

United States Patent [19]

Schoen et al.

[11] Patent Number: 5,557,829

[45] Date of Patent: Sep. 24, 1996

[54] VEHICLE MULTI-LINK HINGE FLUSH POSITIONING ARRANGEMENT

[75] Inventors: Robert M. Schoen, West Bloomfield, Mich.; Gregory E. Thurk, Roscoe, Ill.

[73] Assignee: Chrysler Corporation, Highland Park, Mich.

[21] Appl. No.: 412,493

[22] Filed: Mar. 28, 1995

[51] Int. Cl.[6] ..... E05D 11/00

[52] U.S. Cl. ..... 16/375; 16/371

[58] Field of Search ..... 16/368, 371, 370, 16/286, 287, 288, 289, 374, 375, 294, 292, 302, 240, 241; 180/69.2, 69.21

[56] References Cited

U.S. PATENT DOCUMENTS

| | | | |
|---|---|---|---|
| 2,185,214 | 1/1940 | Claud-Mantle | 16/288 |
| 2,702,401 | 2/1955 | Vigmostad et al. | 16/302 |
| 2,971,227 | 2/1961 | Eliot | 16/375 |
| 3,153,257 | 12/1964 | Daenzer | 16/128.1 |
| 4,186,476 | 2/1980 | Mair et al. | 180/69.21 |
| 4,893,863 | 1/1990 | Skonieczny et al. | 296/76 |
| 5,029,930 | 7/1991 | Ihrke et al. | 296/76 |
| 5,365,639 | 11/1994 | Lewkoski | 16/224 |

*Primary Examiner*—M. Rachuba
*Assistant Examiner*—Donald M. Gurley
*Attorney, Agent, or Firm*—Thomas G. Pasternak

[57] ABSTRACT

A multi-link hinge assembly for a mounting a closure, such as a rear deck lid or front hood, to a vehicle body. An arrangement provides for readily adjusting the closure vertically upwardly from a position wherein the closure exterior surface is vertically lower than the adjacent body side structure exterior surface to a position where the closure exterior surface is in flush relation with the side structure exterior surface. The hinge assembly has a closure-half base plate secured to the underside of the closure and a body-half arm plate secured to an inner side wall of the side structure. A pair of first and second connecting links each have one end pivotally joined to a closure-half hinge base plate flange and an opposite end pivotally joined to the body-half arm plate. The base plate has a vertically disposed adjustment shank threadedly engaged in the base plate with the shank having a bumper head on its lower end contacting a stop flange of the body-half arm plate. The adjustment shank provides ready vertical upward adjustment of the closure exterior surface to its design position flush with the adjacent exterior surface of the body side structure.

7 Claims, 4 Drawing Sheets

46
68
52
50
32
74
72
70
38
35
44
40
51
42
64
65
66
53

70
76
78
82
46
74
A
72
87
88
84
86
49

48
47
68
52
46
47
74
84
50
34
28
66
65
40
44
42

VEHICLE MULTI-LINK HINGE FLUSH POSITIONING ARRANGEMENT

BACKGROUND OF THE INVENTION

This invention relates to vehicle body hinge assemblies for hood/deck lid closures and the like and more particularly to a multi-link hinge assembly incorporating an adjustment arrangement for flush positioning of the closure exterior surface relative to contiguous vehicle body exterior surfaces.

The prior art is replete with vehicle deck lid and hood closures providing adjustable hinge assemblies. The U.S. Pat. No. 5,029,930 issued Jul. 9, 1991 to Ihrke et al., entitled "Adjustable Deck Lid Hinge Pivot" is an example of a "goose neck" type hinge wherein the pivot means can be readily, vertically adjusted to enable the closure to be positioned flush with adjacent exterior body structure of the vehicle when in a closed position. The Ihrke patent includes a hinge box, a vertical slide which carries a hinge pivot and adjustable fastener means comprising a bolt for vertically raising and lowering the slide and cooperable guides on the slide and hinge box for guiding the movement of the slide in a vertical path.

The U.S. Pat. No. 4,893,863 issued Jan. 16, 1990 to Skoieczny et al., and U.S. Pat. No. 5,074,609 issued Dec. 24, 1991 to Dear, both entitled "Adjustable Deck Lid Hinge Pivot" and are assigned to the same assignee as the Ihrake et al. patent, are two more examples of goose neck type vehicle closure hinges providing vertical adjustment of the closure. The U.S. Pat. No. 5,365,639 issued Nov. 22, 1994 to Lewkoski, entitled "Ball And Socket Hinge Assembly With Translatable Screw" is yet another goose neck type vehicle closure hinge having a screw or rod which provides for height adjustment of a deck lid with respect to a vehicle body.

An example of a multi-link hinge for a vehicle deck lid closure is U.S. Pat. No. 3,153,257 issued Oct. 20, 1964 to Daenzer, entitled "Counterbalanced Hinge". An example of a multi-link hinge for a vehicle hood closure is the U.S. Pat. No. 4,382,312 issued May 10, 1983 to Liggett et al., entitled "Multiposition Hood Hinge Mechanism".

It is well known in the art that multi-link hinges for vehicle hood and deck lid closures provide improved packaging and structural integrity for torsion and lateral displacement in comparison to most goose neck type hinges. Multi-link hinges, however, lack close-tolerance exactness as to vertical location of the body-half hinge member relative to the closure-half hinge member. Further, multi-link hinges present assembly line problems in maintaining uniform location of the closure pivot axis. This results from the difficulty in controlling dimensional tolerance stack-up of hinge pivot pins, bushings, link hole diameters, link hole spacing, etc.

SUMMARY OF THE INVENTION

It is an object of the present invention to provide an improved multi-link hinge assembly for vehicle hood and deck lid closures incorporating means for adjusting the closure exterior surface to a flush position relative to adjacent exterior body structure surface without the need to loosen the hinge assembly connections to the body structure or closure.

It is another object of the present invention to provide an improved multi-link hinge assembly for vehicle closures as set forth above wherein a vertically disposed screw shank, terminating in a headed bumper, is mounted on a closure-half hinge plate wherein the bumper is threaded against a body-half hinge plate providing ready vertical adjustment of the closure to its design position flush with the adjacent body structure.

BRIEF DESCRIPTION OF THE DRAWINGS

These and other objects, features and advantages of the invention will appear from the following written description and the accompanying drawings in which:

FIG. 3 is a top view of the hinge assembly of FIG. 2;

DETAILED DESCRIPTION OF THE INVENTION

Figures 1, 2:
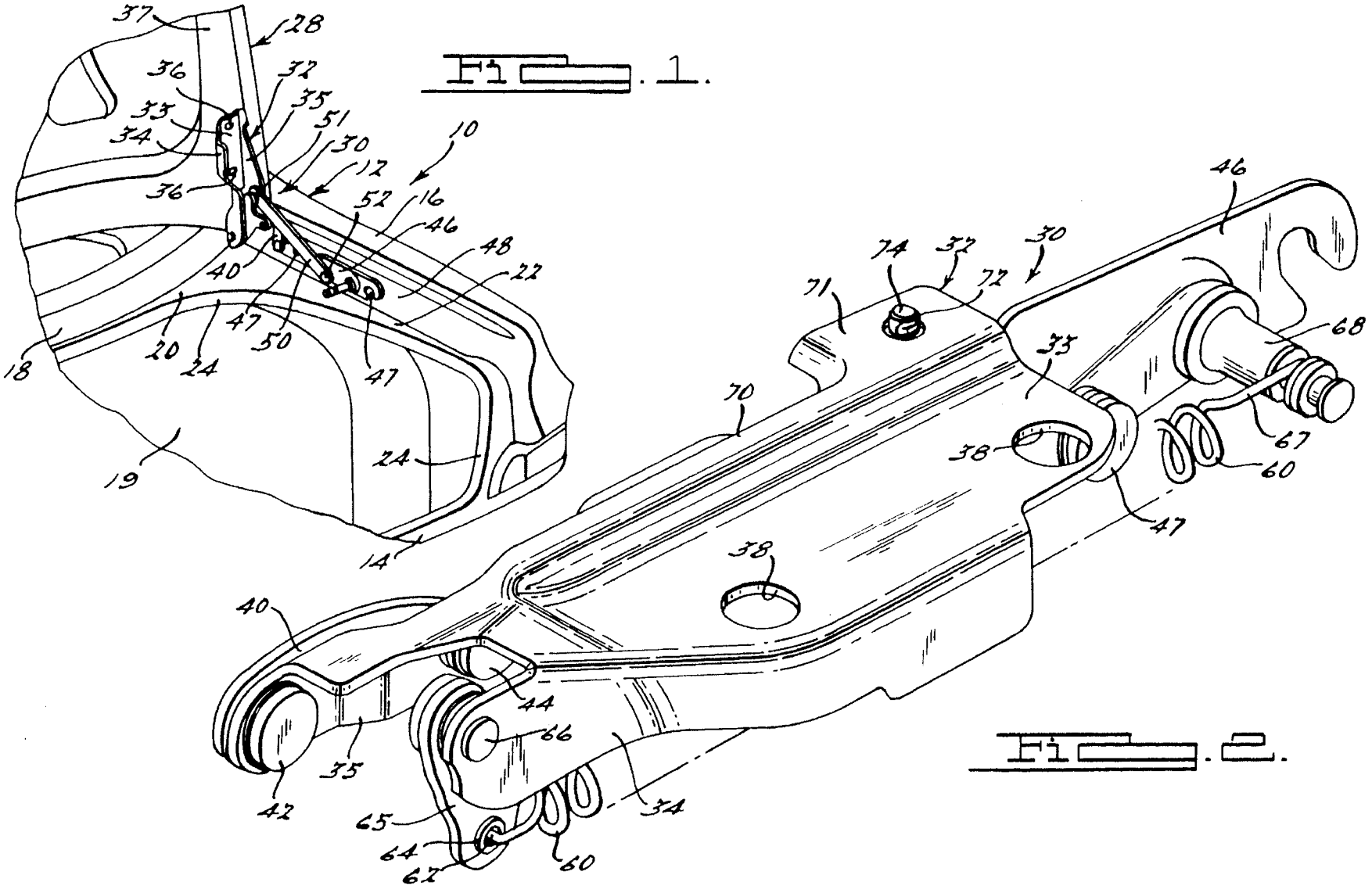
FIG. 1 is a fragmentary perspective view of a vehicle showing a hinge assembly pivotally supporting a deck lid in its fully raised position.
FIG. 2 is an enlarged perspective detail view of the hinge assembly of the present invention.
Figure 2:
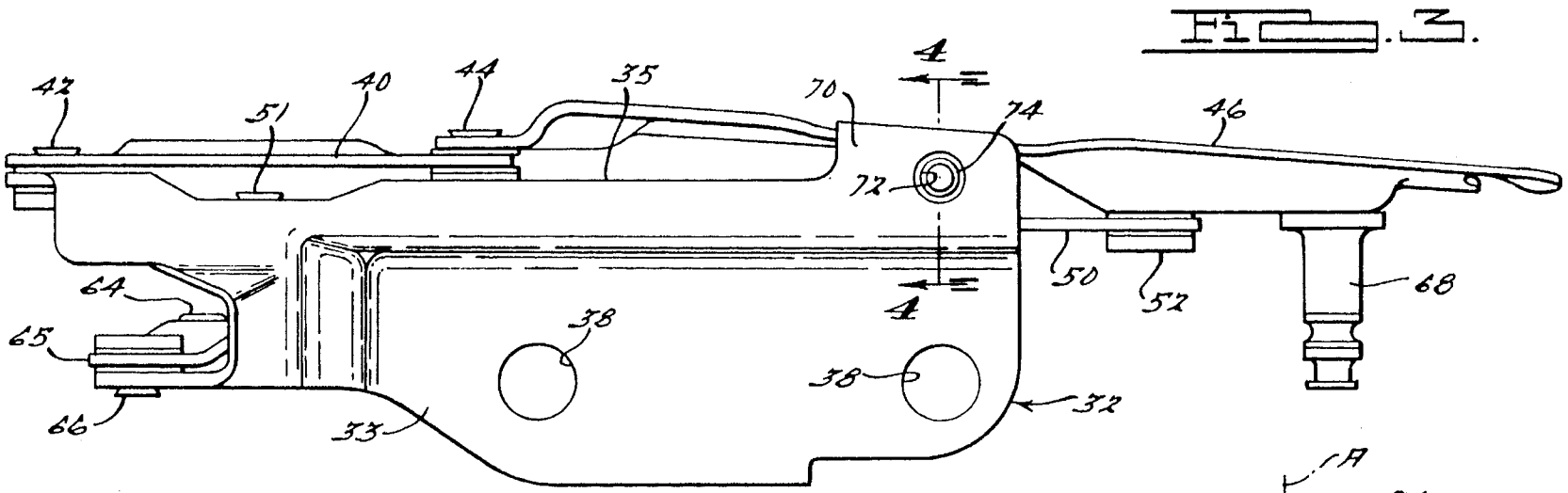

Referring now to the drawings and in particular to FIG. 1, an automotive vehicle 10 has a body 12 including aft end body structure 14 extending transversely of vehicle and a pair of body side structures. In the disclosed form of the invention the side structures are rear quarter panels with only the right side quarter panel being shown at 16. A transversely extending body structure 18 partially defines an opening for a rear window (not shown). A rear trunk compartment 19 has an opening defined by a transversely extending body shelf flange 20, downwardly adjacent from the window structure 18, body side shelf flanges 22 and the transversely extending aft end body structure 14. The trunk compartment opening is surrounded by a circumferentially extending trunk seal 24 while the trunk opening allows access to the compartment 19.

Figure 6:
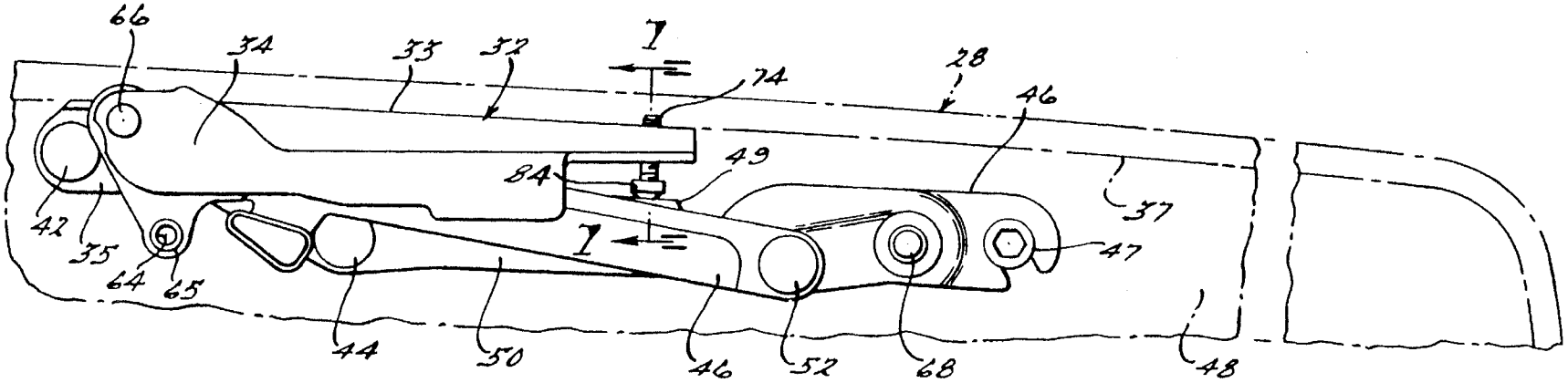
FIG. 6 is a view similar to FIG. 5 showing the adjustable bolt having been threaded to raise the deck lid outer surface into flush relation with the quarter panel outer surface.
Figure 5:
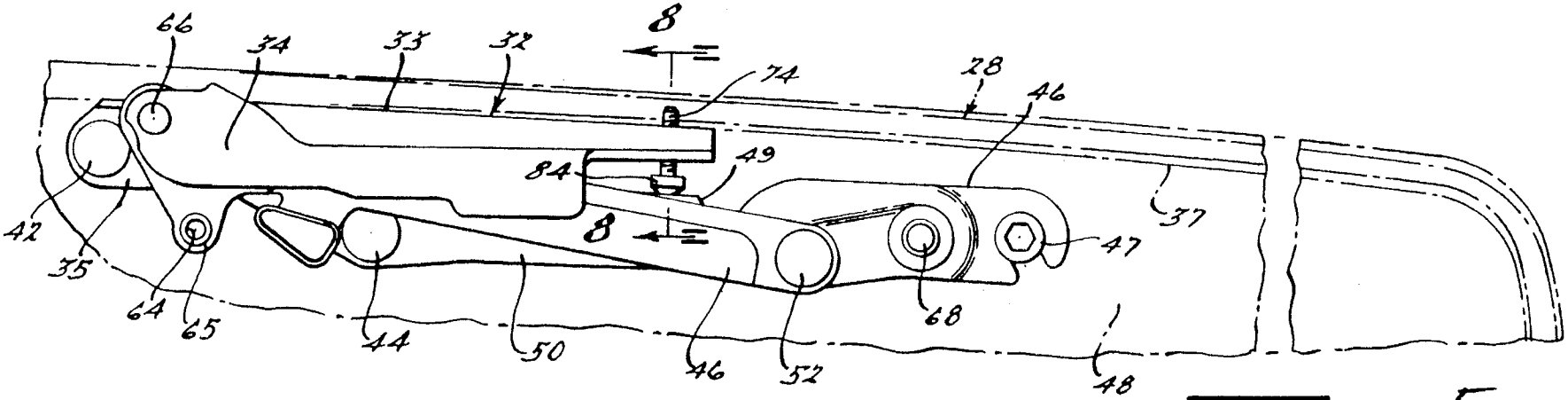
FIG. 5 is fragmentary side view of the right hand hinge assembly looking outboard.

FIG. 1 shows an open deck lid or closure 28, for covering the compartment opening when the closure is in a closed position. The closure 28 is swingably mounted to the inner shelf flange 20 by means of a pair of right and left multi-link hinge assemblies with only the right hand hinge assembly being depicted generally at 30. The hinge assemblies 30 allow the closure 28 to swing between an open position, and a closed position in which the closure closes off access to the rear compartment 19 and engages the seal 24. The closure 28 is adapted to be latched in its closed position, as shown in FIGS. 5 and 6, via a suitable latch mechanism (not shown). Reference may be made to U.S. Pat. No. 4,850,140 issued Jul. 25, 1989 to Compeau et al. for details of a typical deck lid latching mechanism and striker, the disclosure of which is incorporated by reference herein.

The hinge assemblies are identical except as to hand, i.e. mirror images of each other, and accordingly only the right hand hinge assembly 30 will be shown and described. As seen in FIG. 1 the link-type hinge assembly 30 comprises a U-sectioned closure-half hinge bracket 32 having a base plate 33 formed with a pair of generally longitudinally extending inboard 34 and outboard 35 legs projecting perpendicularly from the base plate 33. The closure-half hinge bracket base plate 33 is secured by a pair of bolts 36, extending through associated base plate bolt holes 38 (FIG. 2), into an inner panel 39 (FIG. 7) of the closure 28.

Figure 1A:
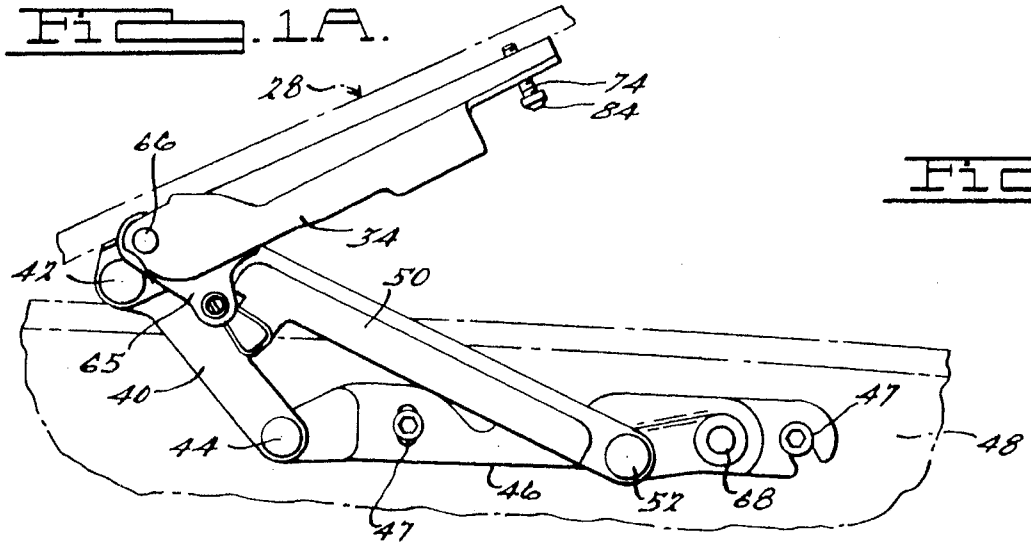
FIG. 1A is a fragmentary side view of the hinge assembly taken in the direction of arrow "1A" of FIG. 1 with the deck lid shown in a partially raised position.
Figure 7:
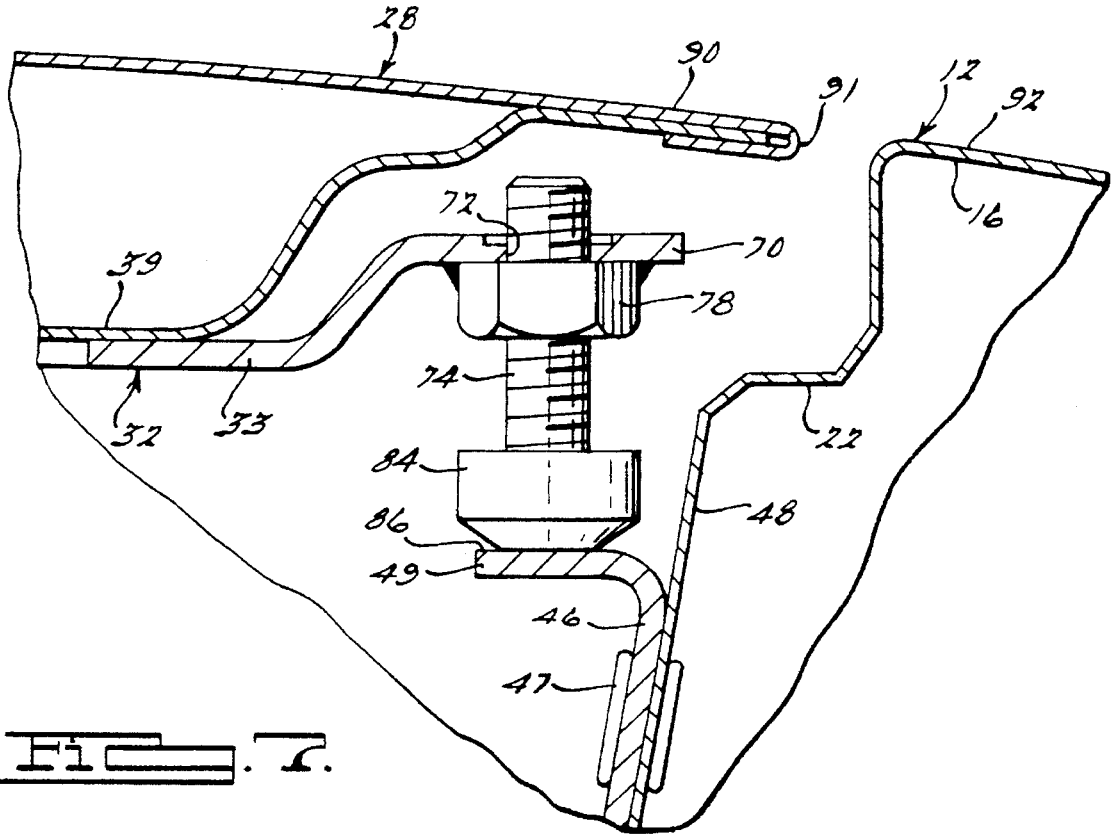
FIG. 7 is an enlarged fragmentary transverse vertical section taken on the line 7—7 of FIG. 5.
Figure 8:
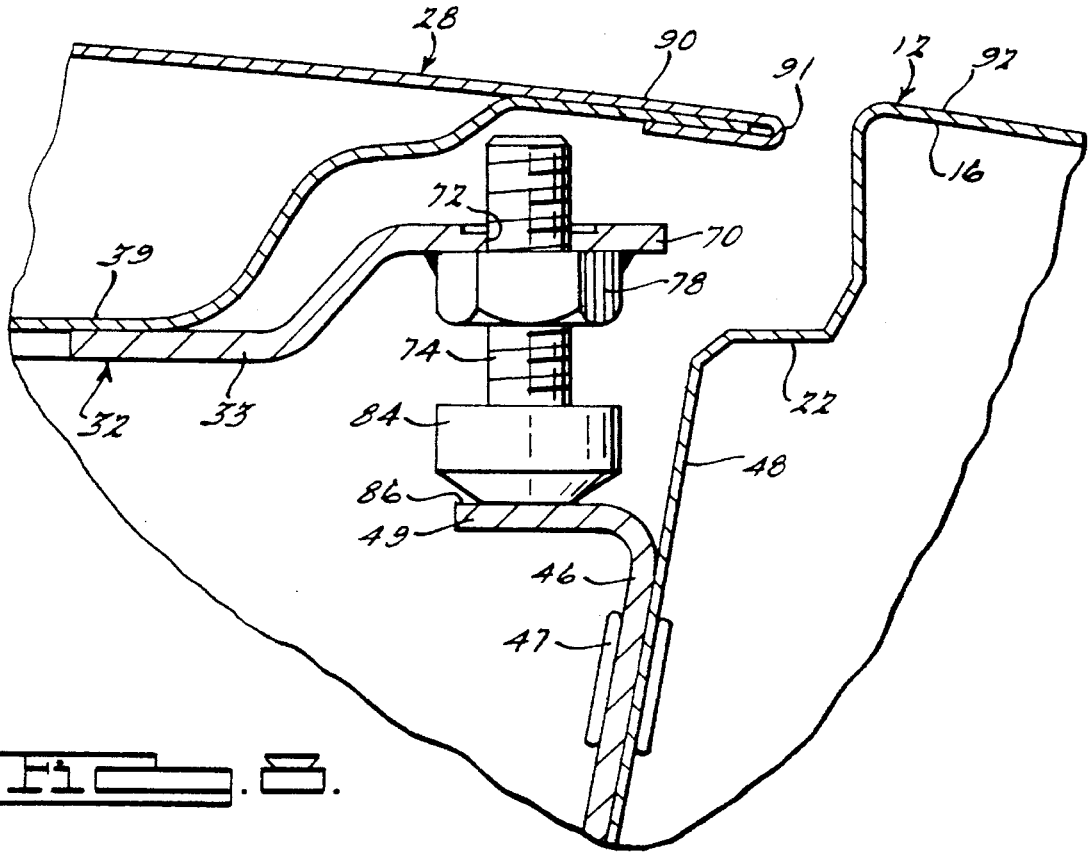
FIG. 8 is a view similar to FIG. 7 taken on the line 8—8 of FIG. 6.

As best seen in FIG. 1A the hinge assembly multi-link moving means or folding linkage for the closure 28 comprises a first short link 40 rotatable about its one end by a transverse pivot pin 42 extending from the forward end of closure-half outboard leg 35. FIG. 3 shows the first link 40 having its other end pivotally connected to a transverse pin 44 extending from a forward end of a body-half hinge arm plate 46. FIGS. 7 and 8 show the arm plate 46 secured by a pair of rivets 47 in a flush manner to interior surface of a compartment side wall 48. It will be noted that in the disclosed embodiment the mounting side wall 48 is an interior quarter panel flange shown extending downwardly and inwardly at a slight angle from the right hand side quarter panel 16. It will be noted in FIGS. 7 and 8 that the arm plate 46 has an upper edge formed with an inboard projecting, horizontally disposed stop flange 49 for a purpose to be explained.

A second long link 50 has its one forward end pivotally connected to a transverse pin 51 extending from the closure-half hinge bracket outboard leg 35. The long link 50 has its other aft end pivotally connected to a transverse pivot pin 52 extending from the body-half hinge arm 46 adjacent its aft end. The links 40 and 50 move from a fully folded position in the fully closed position of the closure 28 (FIG. 2) to a generally unfolded position in the fully open position of the closure 28 shown in FIGS. 1 and 1A. Thus, the pair of links 40 and 50 are each pivotally connected at their opposite ends to the closure bracket outboard flange 35 and the body-half hinge arm 46 for movement in the plane of opening and closing movements of the closure 28.

With reference to the hinge assembly closed position of FIG. 2 it will be seen that a counter-balance helical spring 60 extends generally horizontally in the longitudinal direction of the vehicle. The spring 60 has a forward hooked end 62 connected to an eyelet 64 at one end of spring link 65 which link is pivoted on pivot pin 66. The spring 60 has its opposite hooked end 67 connected to spring post 68.

As seen in FIGS. 2 and 7 the closure-half base plate 33 is formed with an upwardly offset outboard plate portion 70. The offset plate portion 70 is formed at its aft end with an outboard extending plate upwardly offset tab portion 71 provided with a clearance hole 72. It will be noted in FIG. 4 the hole 72 has its center aligned on principal axis "A" of an adjustable screw shank 74 shown engaging threaded bore 76 of a torque weld nut 78 secured by welds 80 to the underside of the offset flange 70. A head 82 is formed on the lower end of the shank 74 for containment of an outer bumper 84 formed of suitable elastomeric or plastic material.

Figure 4:
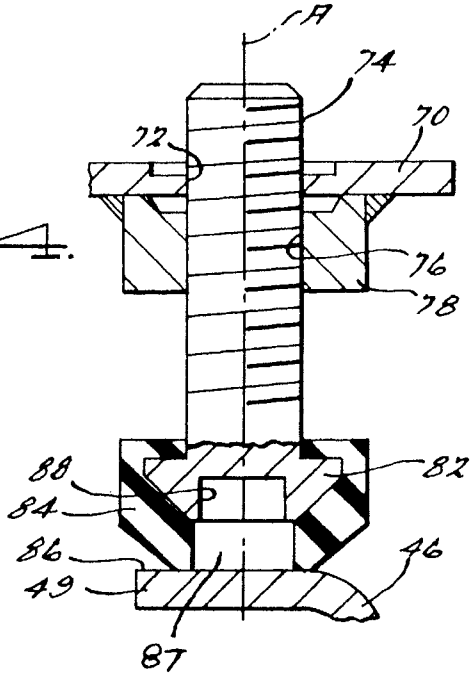
FIG. 4 is a fragmentary vertical sectional view taken on the line 4—4 of FIG. 3.

FIG. 4 shows the bumper 84 contacting upper surface 86 the body-half arm plate stop flange 49. It will be seen that in the disclosed embodiment a concentric blind bore 87 is provided in the bumper 84 permitting access to a hex-shaped concentric socket 88 in the shank head portion 82. The recessed socket 88 allows ready rotational adjustment of the screw shank 74 by means of a matching wrench.

With reference to FIG. 8 it will be noted that in one form of the invention closure 28 is designed such that its exterior surface 90 is nominally "underflush" relative to exterior surface 92 of the adjoining side panel 16. Thus, during a vehicle assembly line operation the closure 28 is checked to insure that its exterior surface 90, adjacent closure longitudinal side edge 91, is flush with the exterior surface 92 of the side panel 16 along longitudinal side edge 93 of the panel 16. If adjustment is needed the screw shank 74 is threaded in the torque nut 78 to increase the vertical dimension between the body-half arm plate stop flange 49 and the overlying closure-half offset tab portion 71 of the base plate offset flange 70. As seen in FIG. 7 rotation of the screw shank 74 moves the closure 28 upwardly to provide a flush condition of its exterior surface 90 with exterior surface 92 of the body panel 16 thereby obviating any hinge assembly 30 out-of-tolerance misalignment. It will be appreciated that slight production variations are absorbed by elastic deformation of the hinge assembly 30 and closure 28.

While the principles of the present invention in connection with the specific vehicle closure hinge assembly has been described, it is to be understood the foregoing detailed description has been made by way of example only and not as a limitation as to the scope of the invention as set for in the accompanying claims.

What is claimed is:

1. A multi-link hinge assembly for use as hinge means in an automotive vehicle having laterally spaced body side structures and longitudinally spaced supports extending transversely to the side structures which together define a compartment having a top opening, a closure having longitudinally extending side edges and an exterior surface, a laterally spaced pair of such hinge means swingably supporting one hinged end of the closure for movement between an upwardly extending open position to permit access to the compartment and a substantially horizontally disposed longitudinally extending closed position in which the closure covers the compartment, said multi-link hinge assembly comprising:

a longitudinally extending closure-half bracket having first and second ends, said bracket secured to an underside of the closure with said bracket first end adjacent the closure one hinged end;

a longitudinally extending body-half arm having first and second ends, said arm secured to an associated side structure of the compartment with said arm first end adjacent the closure one hinged end;

first and second links each pivotally connected at opposite ends to said bracket and said arm respectively, for movement in the plane of opening and closing movements of the closure;

wherein said bracket second end has an outboard extending tab portion that, when said closure is in said closed position, overlies an inboard extending stop portion of said arm, wherein said portions are in vertically spaced parallel relationship to each other;

said bracket outboard tab portion providing a threaded bore and an adjustable screw shank threadedly engaged with said bore, said shank terminating at its lower end in a head portion that, in said closure closed position, contacts an opposed surface of said arm stop portion to provide for vertical adjustment of an associated one longitudinal side edge of the closure for alignment of said side edge with said compartment opening, thereby minimizing adjustment of the hinge assembly body-half arm relative to its associated side structure.

2. The multi-link hinge assembly as set forth in claim 1 wherein said first link has one end thereof pivotally secured to said first end of said closure-half bracket and its other end pivotally secured to said first end of said body-half arm; and said second link has one end pivotally secured to said closure-half bracket intermediate said first and said second bracket ends and its other end pivotally secured to said body-half arm intermediate said first and second arm ends.

3. The multi-link hinge assembly as set forth in claim 2 wherein said first link is relatively shorter than said second link.

4. The multi-link hinge assembly as set forth in claim 1 wherein said hinge closure-half bracket is generally U-shaped defining a base plate secured to the closure underside, said base plate having inboard and outboard longitudinally extending legs, said base plate second end formed with said outboard projecting tab portion, said tab portion provided with a clearance hole, a nut, defining the tab portion threaded bore, secured to an underside of said tab portion, and said tab portion hole having its center aligned on the principal axis of said nut threaded bore so as to allow passage therethrough of said shank.

5. The multi-link hinge assembly as set forth in claim 4 wherein said hinge body-half arm is a plate secured to a longitudinally extending side wall of said body side structure, said arm plate formed with a stop flange extending inboard from said arm plate and forming said stop flange portion underlying said bracket base plate tab portion.

6. The multi-link hinge assembly as set forth in claim 1 wherein said screw shank head portion includes a head shaped to retain an outer plastic bumper adapted to contact said arm stop portion opposed surface.

7. The multi-link hinge assembly as set forth in claim 6 wherein said outer bumper is circular in horizontal section and formed with a concentric blind bore terminating in a hex-shaped concentric socket in said shank head adapted to receive therein a matching wrench enabling ready rotational adjustment of said screw shank.

* * * * *